United States Patent [19]

Tokura et al.

[11] Patent Number: 4,541,239

[45] Date of Patent: Sep. 17, 1985

[54] EXHAUST PURIFICATION APPARATUS

[75] Inventors: Naomi Tokura, Yokosuka; Yoji Hasegawa, Yokohama, both of Japan

[73] Assignee: Nissan Motor Company, Ltd., Japan

[21] Appl. No.: 614,061

[22] Filed: May 25, 1984

[30] Foreign Application Priority Data

Jun. 20, 1983 [JP] Japan ..... 58-109283

[51] Int. Cl.[4] ..... F01N 3/02

[52] U.S. Cl. ..... 60/286; 55/466; 55/DIG. 10; 55/DIG. 30; 60/303; 60/311; 60/738; 431/217

[58] Field of Search ..... 60/286, 303, 311, 738; 55/466, DIG. 10, DIG. 30; 431/217

[56] References Cited

U.S. PATENT DOCUMENTS 2,720,753 10/1955 Sharpe ..... 60/738

4,424,671 1/1984 Tokura ..... 60/286

*Primary Examiner*—Douglas Hart

*Attorney, Agent, or Firm*—Lowe, King, Price & Becker

[57] ABSTRACT

An exhaust purification apparatus includes a regenerative burner for repetitively regenerating a trap element located in the exhaust system of an internal combustion engine. The regenerative burner has a combustion chamber adapted to permit flow of exhaust gases from the engine exhaust conduit to the trap element. A cup-shaped member is disposed within the combustion chamber to define therein an evaporation chamber which has an adequate supply of air-fuel mixture. The cup-shaped member has a peripheral wall formed with cutouts to permit air-fuel mixture from said evaporation chamber into said combustion chamber and also with a hole to permit fuel droplets to fall onto a glow plug located below the cup-shaped member within the combustion chamber. A protective cover is provided to cover the path of dropping of fuel droplets onto the glow plug to prevent air from flowing to cool down the glow plug and deviate the fuel droplets away from the glow plug.

7 Claims, 4 Drawing Figures

EXHAUST PURIFICATION APPARATUS

BACKGROUND OF THE INVENTION

This invention relates to an apparatus including a regenerative burner for repetitively regenerating a trip element located in the exhaust system of an internal combustion engine.

It has been proposed to purify exhaust gas from an automobile internal combustion engine by employing a trap or particle filter element located in the exhaust system of the engine to collect therein carbon or other particles included in the exhaust gas discharged from the engine. The trap element should be repetitively regenerated each time a regeneration requirement occurs; that is, when the amount of the exhaust particles collected in the trap element reaches a limit value. For this purpose, a regenerative burner is disposed in the exhaust system upstream of the trap element, the regenerative burner including a glow plug operable to ignite and burn an air-fuel mixture supplied into the burner so as to burn the exhaust particles collected in the trap element when a regeneration requirement occurs.

The regenerative burner has a liner closed at its upstream end by an end plate to define therein a combustion chamber opening toward the trap element. The liner has a peripheral wall formed with holes or slits to permit flow of exhaust gas from the engine exhaust conduit to the trap element. A cup-shaped member is disposed within the combustion chamber to define therein an evaporation chamber which has an adequate supply of air-fuel mixture. The cup-shaped member has a peripheral wall formed with holes or slits to permit fuel droplets to fall onto the glow plug located below the cup-shaped member within the combustion chamber. The glow plug is actuated to ignite fuel droplets falling thereon to ignite the air-fuel mixture blown off into the combustion chamber when a regeneration requirement occurs.

A disadvantages with such an apparatus is that the flow of air-fuel mixture from the evaporation chamber into the combustion chamber causes fluid flow to cool down the glow plug and deviate the falling fuel droplets away from the glow plug. The result is a degraded ability to ignite the air-fuel mixture.

Therefore, the present invention provides an exhaust purification apparatus including an improved regenerative burner which can provide a higher ability to ignite air-fuel mixture supplied therein.

SUMMARY OF THE INVENTION

There is provided, in accordance with the present invention, an exhaust purification apparatus for use in an internal combustion engine having an exhaust conduit through which exhaust particles are discharged together with exhaust gas to the atmosphere. The apparatus includes a casing having an inlet connected to the exhaust conduit and an outlet connected to the atmosphere. The casing contains a trap element and a regenerative burner located upstream of the trap element.

The regenerative burner comprises a liner located in the casing to define therein a combustion chamber opening toward the trap element. The liner is adapted to permit flow of exhaust gas from the exhaust conduit to the trap element. A cup-shaped member is located in the combustion chamber to define therein an evaporation chamber. The cup-shaped member is adapted to permit an air-fuel mixture from the evaporation chamber into the combustion chamber. The cup-shaped member is also adapted to permit fuel droplets to fall downward.

A mixture conduit has an end terminating in a discharge outlet for supplying an air-fuel mixture into the evaporation chamber. A glow plug has a portion located below the hollow member within the combustion chamber for igniting the fuel droplets falling thereon when actuated.

A protective cover is provided for covering the path of dropping of fuel droplets onto the glow plug to prevent air from flowing to cool down the glow plug and deviate fuel droplets away from the glow plug. A control unit actuates the glow plug and supplies an air-fuel mixture into the evaporation chamber through the mixture conduit when a regeneration requirements occurs.

BRIEF DESCRIPTION OF THE DRAWINGS

The present invention will be described in greater detail by reference to the following description taken in connection with the accompanying drawings, where like reference numerals refer to the same or corresponding parts, and in which.

DESCRIPTION OF THE PREFERRED EMBODIMENT

Figure 1:
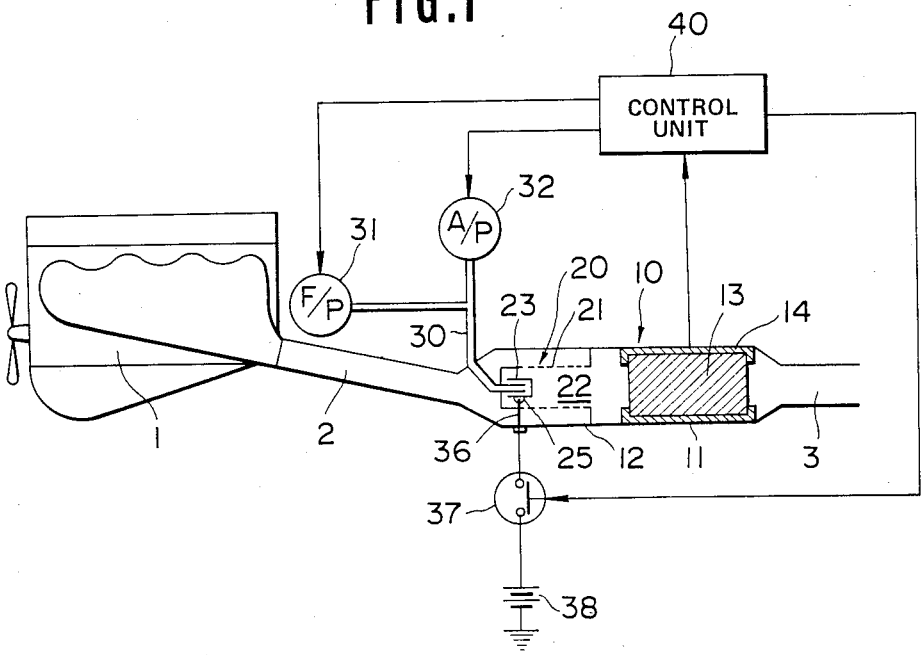
FIG. 1 is a schematic sectional view showing one embodiment of an exhaust purification apparatus made in accordance with the present invention.

In the drawings FIG. 1 illustrates generally at 10 an exhaust purification system of the invention as incorporated in the exhaust system of an internal combustion engine 1 such for example as a diesel engine. The exhaust system may be considered as including an exhaust conduit 2 through which the engine discharges exhaust gas into the purification system 10. The purification system discharges exhaust gas into a connecting conduit 3 which carries it to a sound attenuating muffler (not shown) that discharges into a tailpipe (not shown) that conducts the gas to the atmosphere.

The purification system 10 includes a casing 11 extending between the exhaust conduit 2 and the connecting conduit 3. A trap or particle filter element 13 is supported inside and on the inner surface of the casing 11 by a mounting system 14 that may includes a buffer member. The trap element 13 has a honeycomb structure in which a first multiplicity of passageways closed at their inlet ends and a second multiplicity of passageways closed at their outlet ends are arranged alternatively so that exhaust particles can be collected therein while exhaust gas passes through the walls of the adjacent passageways.

A regenerative burner, which is generally designated at 20, is located inside casing 11 and is actuated to burn the exhaust particles collected in the trap element 13 so as to regenerate the trap element 13 when a regeneration requirement occurs; that is, when the amount of exhaust particles collected in the trap element 13 reaches a predetermined value.

The regenerative burner includes a combustion liner 21 secured to the casing 11 to define therein a combustion chamber 22 opening toward the trap element 13. The combustion liner 21 is adapted to permit flow of exhaust gas from the exhaust conduit 2 through the combustion chamber 22 into the trap element 13. A cylindrical cup-shaped member 23 is fixed at its open end to the combustion liner 21 to define thereon a reverse-flow evaporation chamber 24 with the other end thereof being closed. The cup-shaped member 23 is adapted to permit flow of an air-fuel-mixture from the evaporation chamber into the combustion chamber 22.

The evaporation chamber 24 has an adequate supply of air-fuel mixture through a mixture supply conduit 30 from an air-fuel supply source which includes a fuel pump 31 and an air pump 32. The fuel pump 31 is actuated to supply fuel from a fuel reservoir (not shown) into the mixture conduit 30 on command from a control unit 40. The air pump 32 is actuated on command from the control unit 40 to supply air into the mixture conduit 30 where it is mixed with the fuel supplied through the fuel pump 31. The air-fuel mixture supplied into the evaporation chamber 24 is ignited by the use of a glow plug 36. The glow plug 36 is connected to a battery 38 through a normally open switch 37 which is closed on command from the control unit 40 to actuate the glow plug 36. The glow plug 36 terminates in a portion surrounded by a protective cover 25 located below the evaporation chamber 24 for igniting the fuel droplets falling through an aperture onto it.

The control unit 40 detects a regeneration requirement when a predetermined amount of exhaust particles is collected in the trap element 13. For example, this detection may be made based upon the pressure difference across the trap element 13. In the presence of a regeneration requirement, the control unit 40 turns the switch 37 on to actuate the glow plug 36. The control unit 40 actuates the fuel and air pumps 31 and 32 to supply air-fuel mixture into the evaporation chamber 24 after a delay during which the glow plug 36 increases its temperature to an extent sufficient to ignite the air-fuel mixture.

Figure 2:
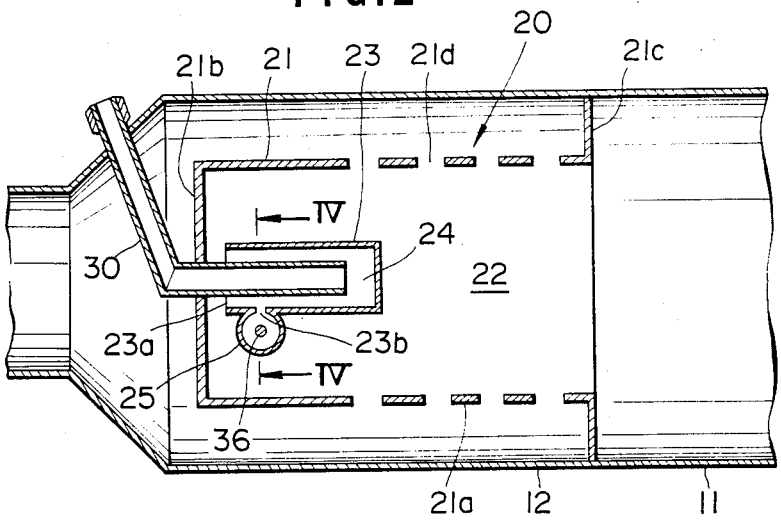
FIG. 2 is an enlarged sectional view showing the detail of the regenerative burner of FIG. 1.
Figure 3:
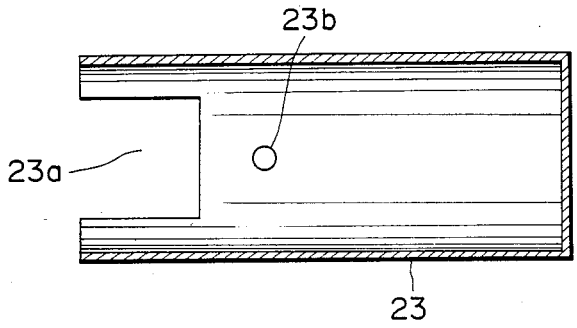
FIG. 3 is an enlarged sectional view showing the cup-shaped member used in the regenerative burner of FIG. 2.
Figure 4:
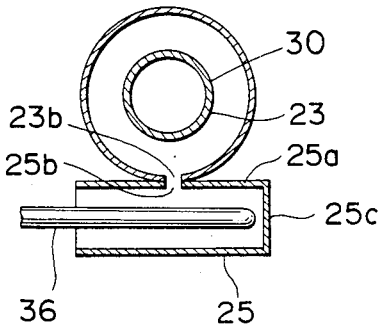
FIG. 4 is an enlarged sectional view taken along the line IV—IV of FIG. 2.

Referring to FIGS. 2 to 4, the regenerative burner 20 will be described in more detail. The combustion liner 21 is shown as having a tubular peripheral wall **21*a* closed at its upstream end by an end wall 21*b* and provided at its upstream open end with an annular flange 21*c* which is secured to the casing 11. The combustion liner 21 is formed in its peripheral wall near its downstream end with a number of holes or slits 21*d* so as to permit flow of exhaust gas from the exhaust conduit 2 through the combustion chamber 22 into the trap casing 11**.

The cylindrical cup-shaped member 23 has a peripheral wall formed near its upstream end with cutouts **23*a*, as best shown in FIG. 3. The cutouts 23*a* serve as mixture jets to permit flow of air-fuel mixture from the evaporation chamber 24 into the combustion chamber 22. The cup-shaped member 23 is also formed in its peripheral wall substantially intermediate its ends with a downwardly facing opening 23*b***.

The protective cover 25 is shown as a protective cylinder attached on the lower portion of the cup-shaped member 23 such as to make its axis intersect perpendicularly to the axis of the cup-shaped member 23. The protective cylinder 25 has an open end through which the glow plug 36 extends into the protective cylinder 25, as best shown in FIG. 4. The protective cylinder 25 is formed in its peripheral wall **25*a* with an aperture 25*b* axially aligned with the aperture 23*b* to permit fuel droplets to fall through the apertures 23*b* and 25*b* onto the glow plug 36. The protective cylinder 25 is closed at the other end thereof by an end wall 25*c* to prevent air flow through the protective cylinder 25 so as to ensure higher ability to ignite air-fuel mixture. An air flow through the protective cylinder 25 will cool down the glow plug 36 and also deviate the falling fuel droplets away from the glow plug 36**.

It should be understood that the protective cover 25 is not necessarily limited to a cylindrical hollow member as described in connection with this embodiment and may be a member of U-shape in section to define, along with the lower portion of the cup-shaped member 23, a chamber having one end opened for reception of the glow plug 36. The only limitation on the protective cover is that it can cover the path of dropping of fuel droplets onto the glow plug 36 to prevent air from flowing to cool down the glow plug and deviate fuel droplets away from the glow plug 36. In addition, a ceramic molding process may be employed to form an intergral unit of the cup-shaped member 23 and the protective cover 25 for higher durability and higher production efficiency.

The operation is as follows: When the engine 1 is running, it discharges exhaust gas through the exhaust conduit 2 into the purification system 10. The discharged exhaust gas flows through the holes or slits **21*d* into the combustion chamber 22 and hence into the trap element 13. While the exhaust gas flows through the trap element 13, it collects exhaust particles therein, for example, on the passageway walls and discharges purified gas into the connecting conduit 3 that conducts the gas to the atmosphere. The amount of the exhaust particles collected in the trap element 13** increases with the lapse of time.

When a predetermined amount of exhaust particles is collected in the trap element 13, the control unit 40 detects this condition and generates a command signal to close the switch 37 so as to connect the glow plug 36 to the battery 38. For example, this detection of the collected exhaust particle amount reaching the predetermined value may be made based upon the pressure differential existing across the trap element 13. After a time delay during which the glow plug 36 increases its temperature to a level sufficient to ignite fuel droplets in the presence of excess oxygen included in the exhaust gases, the control unit 40 generates command signals to actuate the air and fuel pumps 31 and 32 so as to start an adequate supply of air-fuel mixture into the evaporation chamber 24. The air-fuel mixture discharges into the evaporation chamber 24 toward its closed end and reverses in flow direction, and then it flows through the cutouts **23*a* into the combustion chamber 22. The supplied fuel still remains liquefied and falls in drops through the apertures 23*b* and 25*b* onto the glow plug 36** in the early stage of the trap regenerating operation since a diesel engine discharges relatively low-temperature exhaust gas and employs light-oil fuel that evaporates only at relatively high temperature (at least 300° C.).

The protective cover 25 covers the path of dropping of the fuel droplets onto the glow plug 36 to minimize the tendency of air flow to occur so as to cool down the glow plug and deviate fuel droplets away from the glow plug 36, with a resulting higher mixture ignition efficiency.

The glow plug 36 ignites the fuel droplets falling thereon, causing combustion of the air-fuel mixture blowing off the cutouts 23*a* into the combustion chamber 22 to thereby heat the exhaust gas which flows through the holes or slits 21*d* into the combustion chamber 22. The heated exhaust gas flows into the casing 11 where it burns the exhaust particles collected in the trap element 13 so as to regenerate the trap element.

The combustion of the air-fuel mixture flowing into the combustion chamber 22 heats the cup-shaped member 23 to promote evaporation of the fuel flowing through the evaporation chamber 24. Thus, the control unit 40 opens the switch 37 to disconnect the glow plug 36 from battery 38 upon completion of the ignition of the supplied air-fuel mixture. When a predetermined time elapses after the glow plug 28 is disconnected from the battery 38, the control unit 40 stops the operation of the fuel and air pumps 31 and 32 to terminate the supply of air-fuel mixture to the evaporation chamber 24.

The invention achieves higher mixture ignition efficiency, with a resulting less consumption of fuel for the regenerative burner. The achieved higher mixture ignition efficiency also permits the use of a small sized glow plug. This is achieved as a result of a preventive cover adapted to prevent air from flowing to cool down the glow plug and deviate fuel droplets away from the glow plug.

Although the present invention has been described in connection with a specific embodiment thereof, it is evident that many alternatives, modifications and variations will be apparent to those skilled in the art. Accordingly, it is intended to embrace all alternatives, modifications and variations that fall within the broad scope of the appended claims.

What is claimed is:

1. An exhaust purification apparatus for use in an internal combustion engine having an exhaust conduit through which exhaust particles are discharged together with exhaust gas to the atmosphere, including a casing having an inlet connected to said exhaust conduit and an outlet connected to the atmosphere, said casing containing a trap element and a regenerative burner located upstream of said trap element, said regenerative burner comprising:

a liner located in said casing to define therein a combustion chamber opening toward said trap element, said liner being adapted to permit flow of exhaust gas from said exhaust conduit to said trap element;

a cup-shaped member located in said combustion chamber to define therein an evaporation chamber, said cup-shaped member being adapted to permit an air-fuel mixture from said evaporation chamber into said combustion chamber, said cup-shaped member being adapted to permit fuel droplets to fall downward;

a mixture conduit having an end terminating in a discharge outlet for supplying an air-fuel mixture into said evaporation chamber;

a glow plug having a portion located below said cup-shaped member within said combustion chamber for igniting the fuel droplets falling thereon when actuated;

a protective cover for covering the path of dropping of fuel droplets onto said glow plug to prevent fluid from flowing to cool down said glow plug and deviate fuel droplets away from said glow plug; and a control unit responsive to a regeneration requirement for actuating said glow plug and supplying an air-fuel mixture into said evaporation chamber through said mixture conduit.

2. The apparatus claimed in claim 1, wherein said cup-shaped member has an open end attached on said liner and a closed end facing toward said trap element.

3. The apparatus claimed in claim 2, wherein said mixture conduit discharge outlet opens into said evaporation chamber toward said cup-shaped member closed end to cause flow of the supplied mixture to reverse in direction within said evaporation chamber.

4. The apparatus claimed in claim 2, wherein said cup-shaped member has a peripheral wall formed with a hole to permit fuel droplets to fall onto said glow plug therethrough.

5. The apparatus claimed in claim 4, wherein said protective cover includes a hollow cylinder having a closed end and an open end through which said glow plug extends into said hollow cylinder toward said closed end.

6. The apparatus claimed in claim 5, wherein said hollow cylinder has a peripheral wall formed with a hole axially aligned with said hole of said cup-shaped member to permit fuel droplets to fall onto said glow plug therethrough.

7. The apparatus claimed in claim 1, wherein at least one of said hollow member and said protective cover is made of ceramic.

* * * * *